US009496636B2

(12) United States Patent
Uno et al.

(10) Patent No.: US 9,496,636 B2
(45) Date of Patent: Nov. 15, 2016

(54) FEMALE TERMINAL HAVING OPPOSED FIRST AND SECOND PLURALITIES OF RESILIENT PIECES, WITH EACH RESILIENT PIECE HAVING A FREE END AND A CONTACT PORTION NEAR THE FREE END

(71) Applicants: AUTONETWORKS TECHNOLOGIES, LTD., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP)

(72) Inventors: Masafumi Uno, Yokkaichi (JP); Kanji Horiuchi, Yokkaichi (JP); Yoshitomo Tsujii, Yokkaichi (JP); Katsuhiko Aizawa, Yokkaichi (JP); Kensaku Takata, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/397,659

(22) PCT Filed: May 17, 2013

(86) PCT No.: PCT/JP2013/063835

§ 371 (c)(1),
(2) Date: Oct. 29, 2014

(87) PCT Pub. No.: WO2013/172457

PCT Pub. Date: Nov. 21, 2013

(65) Prior Publication Data

US 2015/0133004 A1 May 14, 2015

(30) Foreign Application Priority Data

May 18, 2012 (JP) ..... 2012-114805

(51) Int. Cl.
*H01R 13/428* (2006.01)
*H01R 4/12* (2006.01)

(Continued)

(52) U.S. Cl.
CPC ..... *H01R 13/428* (2013.01); *H01R 4/12* (2013.01); *H01R 11/01* (2013.01);

(Continued)

(58) Field of Classification Search
CPC .... H01R 13/115; H01R 11/22; H01R 24/20; H01R 13/428; H01R 4/48; H01R 13/11
USPC ..... 439/867, 786, 796
See application file for complete search history.

(56) References Cited

U.S. PATENT DOCUMENTS 3,713,080 A * 1/1973 Kennedy ..... H01R 13/113 439/852

(Continued)

FOREIGN PATENT DOCUMENTS

| | | |
|---|---|---|
| JP | 60-95870 | 5/1985 |
| JP | 1-115173 | 8/1989 |
| JP | 4-147580 | 5/1992 |

OTHER PUBLICATIONS

International Search Report of Jul. 2, 2013.

(Continued)

*Primary Examiner* — Abdullah Riyami
*Assistant Examiner* — Justin Kratt
(74) *Attorney, Agent, or Firm* — Gerald E. Hepos; Michael J. Porco; Matthew T. Hespos

(57) ABSTRACT

A female terminal (10) includes a tubular portion (14) into which a male terminal (11) is to be inserted, a plurality of first resilient pieces (23) projecting inwardly of the tubular portion (14) from a bottom wall (15) of the tubular portion (14) and arranged side by side in a direction intersecting with an inserting direction of the male terminal (11) into the tubular portion (14), and a plurality of contact portions (28) arranged at positions of the tubular portion (14) respectively corresponding to the plurality of first resilient pieces (23) and configured to sandwich the male terminal (11) between the plurality of resilient pieces (23) and the contact portions. Since this enables each first resilient piece (23) to apply a proper contact pressure to the male terminal (11), the male terminal (11) is pressed against the second contact portions (28) at a proper contact pressure.

5 Claims, 9 Drawing Sheets

(51) Int. Cl.

| | |
|---|---|
| ***H01R 11/01*** | (2006.01) |
| *H01R 11/22* | (2006.01) |
| *H01R 13/115* | (2006.01) |
| *H01R 24/20* | (2011.01) |
| *H01R 13/11* | (2006.01) |
| *H01R 4/48* | (2006.01) |
| *H01R 4/18* | (2006.01) |
| *H01R 43/16* | (2006.01) |

(52) U.S. Cl.
CPC ..... *H01R 13/113* (2013.01); *H01R 4/184* (2013.01); *H01R 4/48* (2013.01); *H01R 11/22* (2013.01); *H01R 13/11* (2013.01); *H01R 13/115* (2013.01); *H01R 24/20* (2013.01); *H01R 43/16* (2013.01)

(56) References Cited

U.S. PATENT DOCUMENTS

| | | | | |
|---|---|---|---|---|
| 4,460,239 | A * | 7/1984 | Inoue | H01H 85/2035 439/786 |
| 4,699,444 | A | 10/1987 | Isohata | |
| 4,983,132 | A * | 1/1991 | Weidler | H01R 25/162 439/251 |
| 2005/0118891 | A1 | 6/2005 | Chen | |

OTHER PUBLICATIONS

Written Opinion of the International Searching Authority.
Japanese Patent Appl. No.—2012-114805—Office Action issued Mar. 10, 2015.
Chinese Office Action Dated Jan. 29, 2016.
Japanese Patent Appl. No. 2012-114805—Japanese Office Action Jul. 2, 2015.
Chinese Office Action Dated Aug. 24, 2016.

* cited by examiner

FEMALE TERMINAL HAVING OPPOSED FIRST AND SECOND PLURALITIES OF RESILIENT PIECES, WITH EACH RESILIENT PIECE HAVING A FREE END AND A CONTACT PORTION NEAR THE FREE END

BACKGROUND

1. Field of the Invention

The present invention relates to a female terminal to be connected to a male terminal.

2. Description of the Related Art

Conventionally, a female terminal described in Japanese Unexamined Patent Publication No. H04-147580 is known as the one to be connected to a male terminal. This female terminal includes a tubular portion into which the male terminal is to be inserted. A resilient piece to be resiliently brought into contact with the male terminal inserted into the tubular portion is formed in the tubular portion. The male terminal is sandwiched between this resilient piece and an inner wall surface of the tubular portion, whereby the male terminal and the female terminal are electrically connected.

With the female terminal according to the above configuration, if at least one of the male terminal and the female terminal is relatively twisted about an axis of an inserting direction of the male terminal into the tubular portion, a clearance is formed between the resilient piece and the male terminal and a proper contact pressure with the male terminal may not be obtained. Then, electrical connection reliability of the male terminal and the female terminal may be reduced.

The present invention was completed based on the above situation and aims to provide a female terminal capable of providing electrical connection reliability to a male terminal even if at least one of the male terminal and the female terminal is twisted.

SUMMARY OF THE INVENTION

The present invention is directed to a female terminal, including a tubular portion into which a male terminal is to be inserted; a plurality of first resilient pieces projecting inwardly of the tubular portion from a bottom wall of the tubular portion and arranged side by side in a direction intersecting with an inserting direction of the male terminal into the tubular portion; and a plurality of contact portions arranged at positions of the tubular portion respectively corresponding to the plurality of first resilient pieces and configured to sandwich the male terminal between the plurality of resilient pieces and the contact portions.

According to the present invention, the male terminal inserted into the tubular portion enters between the first resilient pieces and the contact portions. The first resilient pieces press the male terminal, whereby the male terminal is pressed against the contact portions at a proper contact pressure. In this way, the male terminal and the female terminal are electrically connected.

If the male terminal is twisted about an axis of the inserting direction of the male terminal into the tubular portion, the plurality of first resilient pieces arranged side by side in the direction intersecting with this inserting direction are resiliently deformed, following a twisting movement of the male terminal. Since this enables each first resilient piece to apply a proper contact pressure to the male terminal, the male terminal is pressed against the contact portions at the proper contact pressure. As a result, even if the male terminal is twisted about the axis of the inserting direction of the male terminal into the tubular portion, electrical connection reliability between the male terminal and the female terminal can be obtained.

The following embodiments are preferable as embodiments of the invention.

The first resilient pieces and the contact portions are preferably arranged at positions near opposite end parts in the direction intersecting with the inserting direction.

According to the above embodiment, the first resilient pieces come into contact with parts of the male terminal near opposite side edges. Since this enables the first resilient pieces to easily follow a twisting movement of the male terminal, electrical connection reliability of the male terminal and the female terminal can be improved.

Preferably, the female terminal includes a first base end portion folded inwardly of the tubular portion at the front end edge of the bottom wall, and the plurality of first resilient pieces extend backward from the first base end portion.

According to the configuration formed with the plurality of first resilient pieces, the rigidity of each first resilient piece may be reduced. Further, if an external matter collides with these first resilient pieces, the first resilient pieces may be deformed. Since the first base end portion is located on the front end edge of the bottom wall according to this embodiment, direct collision of an external matter with the first resilient pieces can be suppressed. Further, since the first base end portion has larger rigidity than the first resilient pieces, it is difficult to deform even if an external matter collides therewith. Since displacements of the first resilient pieces in the tubular portion due to the collision of an external matter are suppressed in this way, a proper contact pressure can be applied to the male terminal.

Preferably, the plurality of contact portions project inwardly of the tubular portion from a ceiling wall of the tubular portion facing the bottom wall and are formed on a plurality of second resilient pieces arranged side by side in the direction intersecting with the inserting direction of the male terminal into the tubular portion.

According to this embodiment, if the male terminal is twisted about the axis of the inserting direction of the male terminal into the tubular portion, the plurality of second resilient pieces arranged side by side in the direction intersecting with this inserting direction are resiliently deformed, following a twisting movement of the male terminal. In this way, each second resilient piece can apply a proper contact pressure to the male terminal.

Further, since the male terminal is sandwiched between the first and second resilient pieces, a proper contact pressure is applied to the male terminal from both the first and second resilient pieces. In this way, electrical connection reliability of the male terminal and the female terminal can be ensured.

The second resilient pieces are preferably arranged at positions near opposite end parts in the direction intersecting with the inserting direction.

According to the above embodiment, the second resilient pieces come into contact with parts of the male terminal near the opposite side edges. Since this enables the second resilient pieces to easily follow a twisting movement of the male terminal, electrical connection reliability of the male terminal and the female terminal can be improved.

Preferably, the female terminal includes a second base end portion folded inwardly of the tubular portion at the front end edge of the ceiling wall, and the plurality of second resilient pieces extend backward from the second base end portion.

According to the configuration formed with the plurality of second resilient pieces, the rigidity of each second resilient piece may be reduced. Further, if an external matter collides with these second resilient pieces, the second resilient pieces may be deformed. Since the second base end portion is located on the front end edge of the ceiling wall according to this embodiment, direct collision of an external matter with the second resilient pieces can be suppressed. Further, since the second base end portion has larger rigidity than the second resilient pieces, it is difficult to deform even if an external matter collides therewith. Since displacements of the second resilient pieces in the tubular portion due to the collision of an external matter collides therewith. Since displacements of the second resilient pieces in the tubular portion due to the collision of an external matter are suppressed in this way, a proper contact pressure can be applied to the male terminal.

According to the present invention, the female terminal can provide electrical connection reliability to the male terminal even if at least one of the male terminal and the female terminal is twisted.

DETAILED DESCRIPTION

Figure 1:
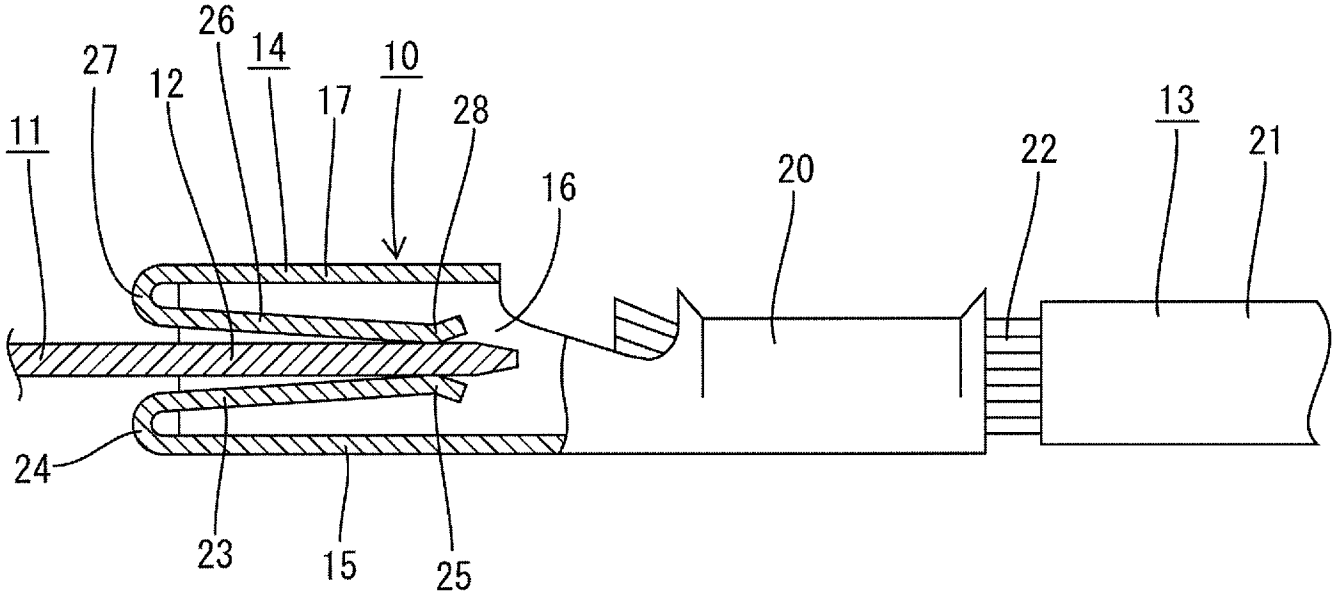
FIG. 1 is a side view partly in section showing a female terminal according to one embodiment of the present invention.

One embodiment of the present invention is described with reference to FIGS. 1 to 9. A female terminal 10 according to this embodiment is electrically connected to a male terminal 11. In the following description, left and right sides in FIG. 1 are referred to as front and rear sides. Further, upper and lower sides in FIG. 1 are reference to as upper and lower sides.

(Male Terminal 11)

The male terminal 11 is formed by press-working a metal plate material into a predetermined shape. The male terminal 11 includes a male tab 12 in the form of a long and narrow plate. The male terminal 11 may be connected to an end of an unillustrated wire or may be connected to an unillustrated device.

(Female Terminal 10)

Figure 2:
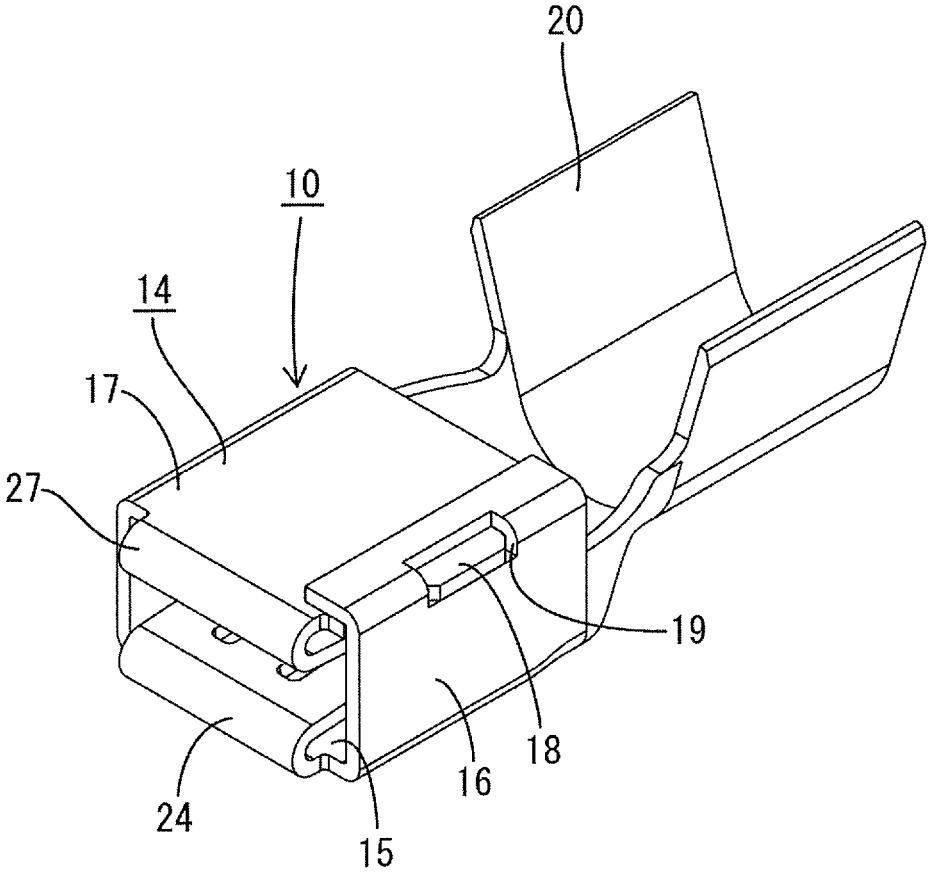
FIG. 2 is a perspective view showing the female terminal.
Figure 3:
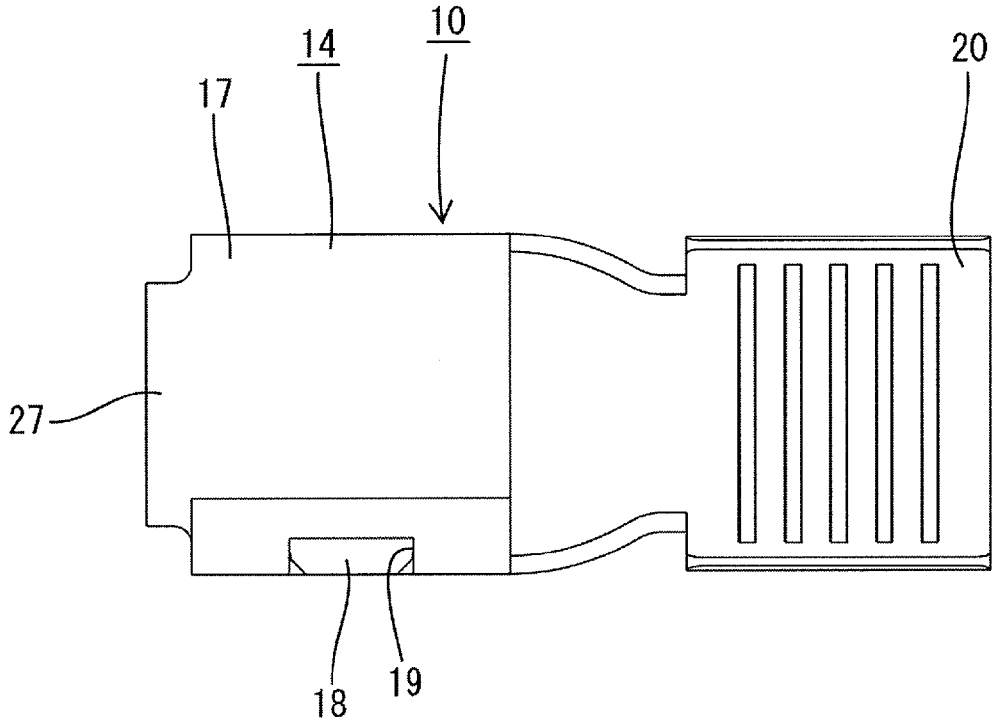
FIG. 3 is a plan view showing the female terminal.
Figure 4:
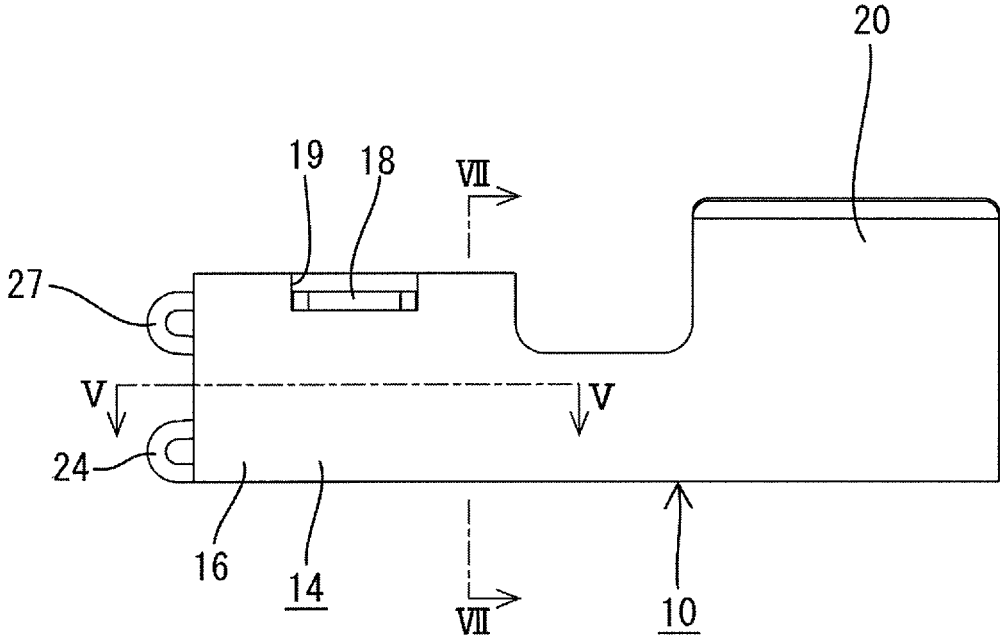
FIG. 4 is a side view showing the female terminal.

The female terminal 10 includes a tubular portion 14 into which the male tab 12 of the male terminal 11 is to be inserted. As shown in FIGS. 2 to 4, the tubular portion 14 is substantially in the form of a rectangular tube open forward and backward. The tubular portion 14 includes a bottom wall 15, a pair of side walls 16 standing upward from opposite side edges of the bottom wall 15 and a ceiling wall 17 facing the bottom wall 15.

The ceiling wall 17 is formed by being bent substantially at a right angle at the upper end edge of one of the pair of side walls 16 toward the other side wall 16. A locking portion 18 is formed to project on a side end edge of the ceiling wall 17 and inserted into a locking hole 19 formed on the other side wall 16. A side end edge of the other side wall 16 is folded onto the upper surface of the ceiling wall 17. In this way, the tubular portion 14 is held in a rectangular tube shape.

A wire barrel 20 extends behind the bottom wall 15. A core 22 exposed from an insulation coating 21 at an end of a wire 13 is connected to this wire barrel 20. The wire barrel 20 is so crimped as to be wound around the outer surface of the core 22.

(First Resilient Pieces 23)

A first base end portion 24 is formed to project on the front end edge of the bottom wall 15. The first base end portion 24 is folded inwardly of the tubular portion 14 at the front end edge of the bottom wall 15. As shown in FIG. 4, the first base end portion 24 slightly projects forward from the front end edge of the tubular portion 14.

Figure 5:
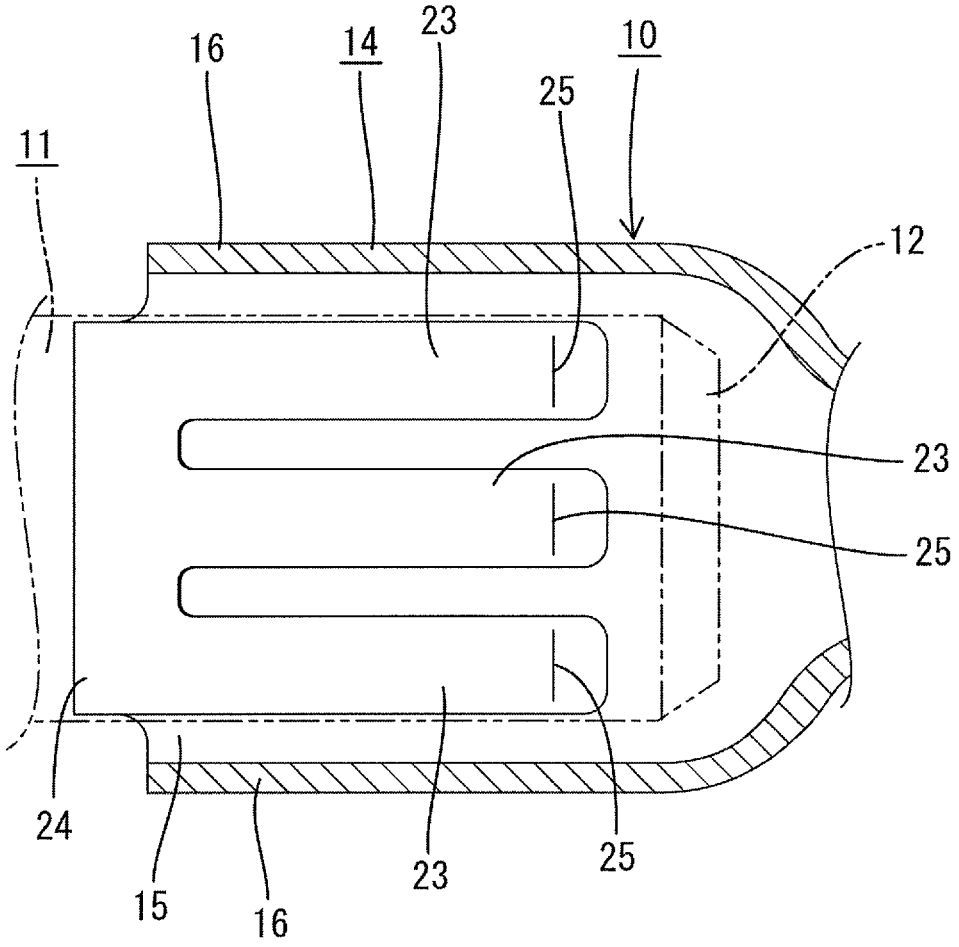
FIG. 5 is a section along V-V of FIG. 4.

As shown in FIG. 5, a plurality of (three in this embodiment) first resilient pieces 23 arranged side by side at intervals in a direction intersecting with an inserting direction of the male terminal 11 are formed on the rear end edge of the folded first base end portion 24 to project inwardly of the tubular portion 14. Each first resilient piece 23 is formed to have substantially the same length in a front-back direction. Further, each first resilient piece 23 is formed to have substantially the same width in a direction perpendicular to the inserting direction of the male terminal 11.

The first resilient pieces 23 are formed at least at positions near opposite end parts in the direction intersecting with the inserting direction of the male terminal 11 to come into contact with parts of the male terminal 11 near opposite side edges.

As shown in FIG. 1, a rear end part of the first resilient piece 23 is bent downwardly. This causes the first resilient piece 23 to be chevron-shaped when viewed laterally. A tip part of this chevron shape serves as a first contact portion 25 to be resiliently brought into contact with the male terminal 11. The first contact portion 25 is formed on each first resilient piece 23.

(Second Resilient Pieces 26)

A second base end portion 27 is formed to project on the front end edge of the ceiling wall 17. The second base end portion 27 is folded inwardly of the tubular portion 14 at the front end edge of the ceiling wall 17. As shown in FIG. 4, the second base end portion 27 slightly projects forward from the front end edge of the tubular portion 14.

Figure 6:
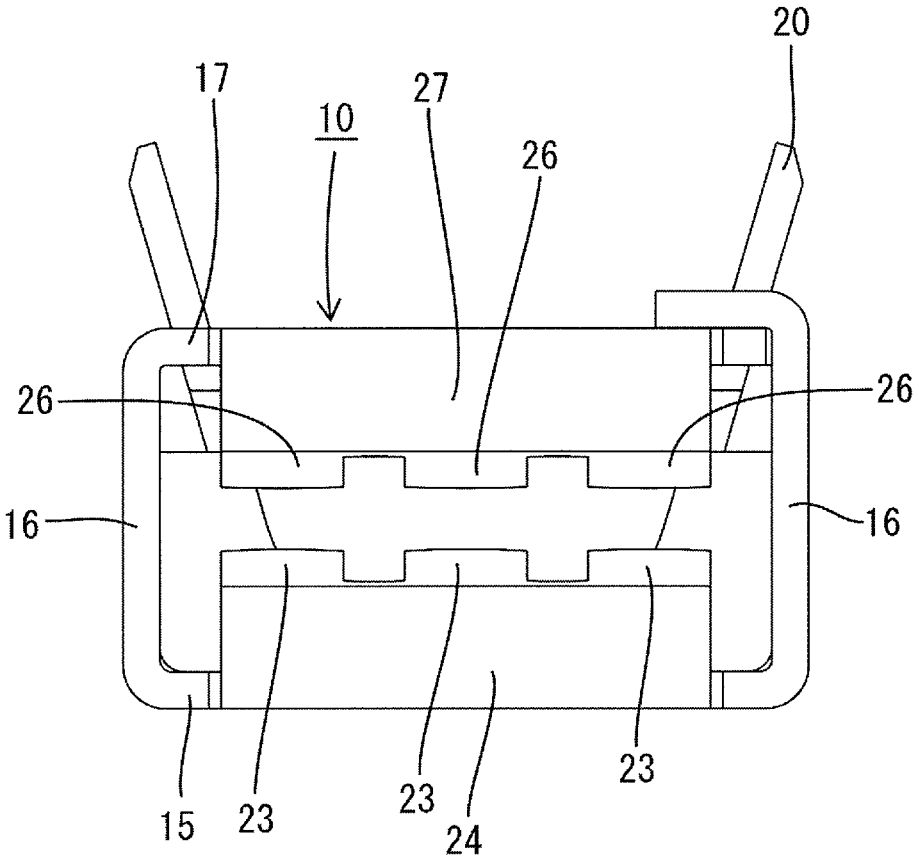
FIG. 6 is a front view showing the female terminal.
Figure 7:
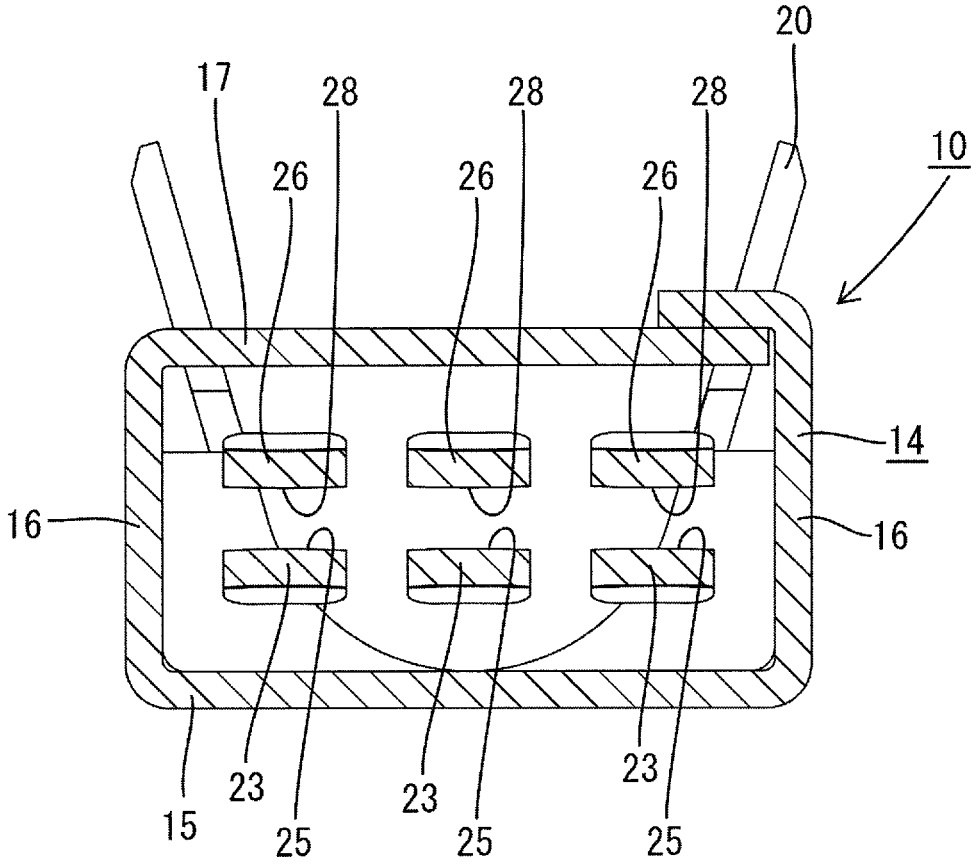
FIG. 7 is a section along VII-VII of FIG. 4.

As shown in FIGS. 6 and 7, a plurality of (three in this embodiment) second resilient pieces 26 arranged side by side at intervals in the direction intersecting with the inserting direction of the male terminal 11 are formed on the rear end edge of the folded second base end portion 27 to project inwardly of the tubular portion 14. Each second resilient piece 26 is formed to have substantially the same length in the front-back direction. Further, each second resilient piece 26 is formed to have substantially the same width in the direction perpendicular to the inserting direction of the male terminal 11.

As shown in FIG. 1, a rear end part of the second resilient piece 26 is bent upwardly. This causes the second resilient piece 26 to be valley-shaped when viewed laterally. A bottom part of this valley shape serves as a second contact portion 28 (corresponding to a contact portion) to be resiliently brought into contact with the male terminal 11. The second contact portion 28 is formed on each second resilient piece 26.

As shown in FIGS. 1, 6 and 7, the first base end portion 24 and the first resilient pieces 23 and the second base end portion 27 and the second resilient pieces 26 are vertically symmetrically formed. This causes the first contact portions 25 of the first resilient pieces 23 and the second contact portions 28 of the second resilient pieces 26 to face each other (see FIG. 7).

Although not shown in detail, the second resilient pieces 26 are formed at least at positions near opposite end parts in the direction intersecting with the inserting direction of the male terminal 11 to come into contact with parts of the male terminal 11 near the opposite side edges.

(Functions and Effects of Embodiment)

Figure 8:
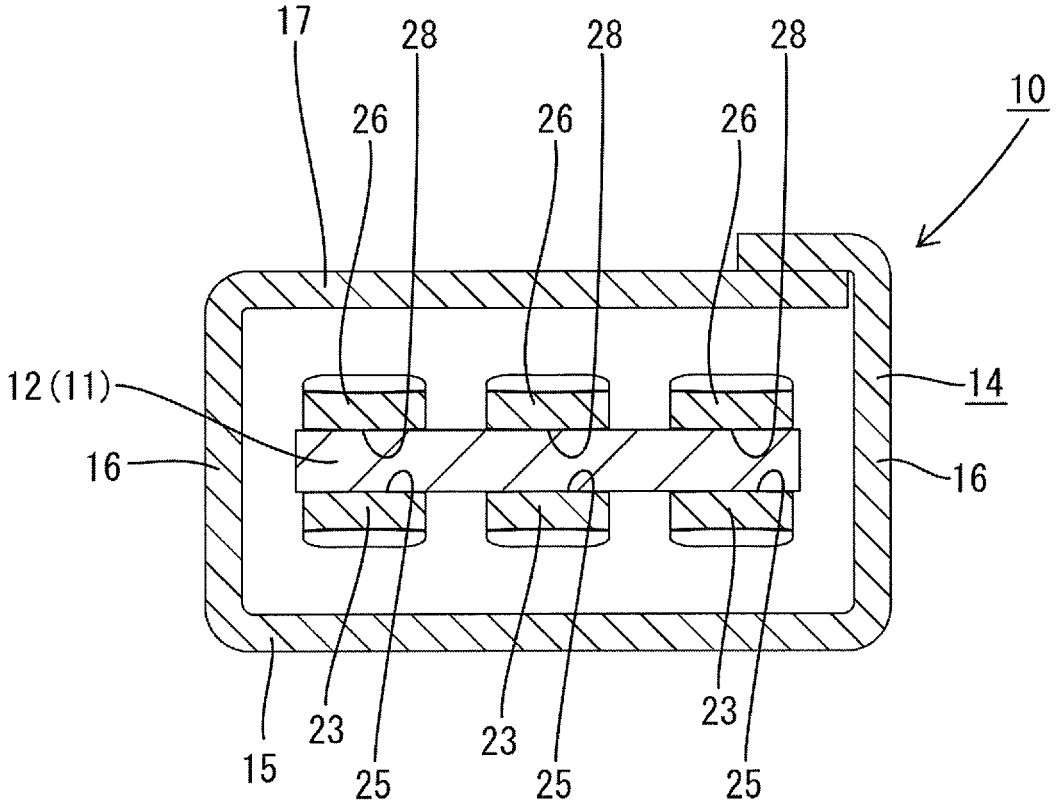
FIG. 8 is a section showing a connected state of a male terminal and the female terminal.

Next, functions and effects of this embodiment are described. As shown in FIG. 8, the male terminal 11 enters between the first resilient pieces 23 and the second resilient pieces 26 when the male terminal 11 is inserted into the tubular portion 14. Then, the first resilient pieces 23 are resiliently deformed downwardly and the second resilient pieces 26 are resiliently deformed upwardly by being pressed by the male terminal 11. When the male terminal 11 moves further backward in the tubular portion 14, the male terminal 11 enters between the first contact portions 25 of the first resilient pieces 23 and the second contact portions 28 of the second resilient pieces 26. The male terminal 11 is pressed by resilient forces of the first resilient pieces 23, thereby being pressed against the second contact portions 28 at a proper contact pressure. On the other hand, the male terminal 11 is pressed by resilient forces of the second resilient pieces 26, thereby being pressed against the first contact portions 25 at a proper contact pressure. In this way, the male terminal 11 and the female terminal 10 are electrically connected.

Figure 9:
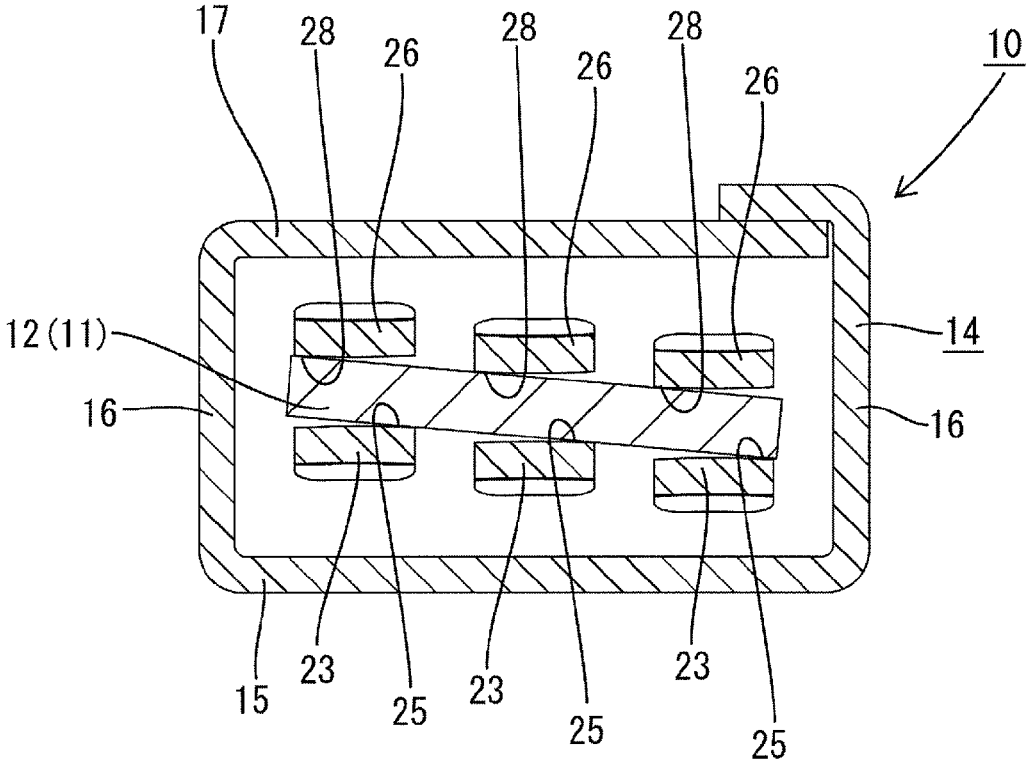
FIG. 9 is a section showing a state where the male terminal is twisted.

FIG. 9 shows a state where the male terminal 11 is relatively twisted about an axis of the inserting direction of the male terminal 11 into the tubular portion 14. In this embodiment, the male terminal 11 is twisted in a clockwise direction of FIG. 9 about the axis of the inserting direction (direction penetrating through the plane of FIG. 9). Since the plurality of first resilient pieces 23 are formed side by side in the direction intersecting with the inserting direction of the male terminal 11, each first resilient piece 23 is resiliently deformed, following a twisting movement of the male terminal 11. Since each first resilient piece 23 can apply a proper contact pressure to the male terminal 11 in this way, the male terminal 11 is pressed against the second contact portions 28 at a proper contact pressure.

Similarly, the plurality of second resilient pieces 26 arranged in the direction intersecting with the inserting direction of the male terminal 11 are also resiliently deformed, following the twisting movement of the male terminal 11. In this way, each second resilient piece 26 can apply a proper contact pressure to the male terminal 11.

Since the proper contact pressure is applied to the male terminal 11 from both the first and second resilient pieces 23, 26, electrical connection reliability between the male terminal 11 and the female terminal 10 can be obtained even if the male terminal 11 is twisted about the axis of the inserting direction of the male terminal 11 into the tubular portion 14.

Further, according to the configuration formed with the plurality of first resilient pieces 23, the rigidity of each first resilient piece 23 may be reduced. Further, if an external matter collides with these first resilient pieces 23, the first resilient pieces 23 may be deformed. Since the first base end portion 24 is located on the front end edge of the bottom wall 15 according to this embodiment, direct collision of an external matter with the first resilient pieces 23 can be suppressed. Further, since the first base end portion 24 has larger rigidity than the first resilient pieces 23, it is difficult to deform even if an external matter collides therewith. Since displacements of the first resilient pieces 23 in the tubular portion 14 due to the collision of an external matter are suppressed in this way, a proper contact pressure can be applied to the male terminal 11.

Similarly, since the second base end portion 27 is located on the front end edge of the ceiling wall 17, direct collision of an external matter with the second resilient pieces 26 can be suppressed. Further, since the second base end portion 27 has larger rigidity than the second resilient pieces 26, it is difficult to deform even if an external matter collides therewith. Since displacements of the second resilient pieces 26 in the tubular portion 14 due to the collision of an external matter are suppressed in this way, a proper contact pressure can be applied to the male terminal 11.

The first and second resilient pieces 23, 26 are arranged at the positions near the opposite end parts in the direction intersecting with the inserting direction of the male terminal 11 into the tubular portion 14 in the tubular portion 14. This causes the first and second resilient pieces 23, 26 to come into contact with the parts of the male terminal 11 near the opposite side edges. Since this enables the first and second resilient pieces 23, 26 to easily follow a twisting movement of the male terminal 11 even if the male terminal 11 is twisted about the axis of the inserting direction into the tubular portion 14, electrical connection reliability of the male terminal 11 and the female terminal 10 can be improved.

Other Embodiments

The present invention is not limited to the above described and illustrated embodiment. For example, the following embodiments are also included in the technical scope of the present invention.

(1) Without limitation to the male terminal 10 to be connected to the wire 13, the female terminal 10 may be connected to an unillustrated device or formed on the tip of a busbar.

(2) Although three first resilient pieces 23 and three second resilient pieces 26 are formed in this embodiment, there is no limitation to this and two first resilient pieces 23 and two second resilient pieces 26 may be formed or four or more first resilient pieces 23 and four or more second resilient pieces 26 may be formed.

(3) Although the contact portions are formed on the second resilient pieces 26 in this embodiment, there is no limitation to this and they may be formed to project inwardly of the tubular portion 14 from the ceiling wall 17.

(4) Although the first and second resilient pieces 23, 26 are vertically symmetrically formed in this embodiment, there is no limitation to this and the first and second resilient pieces 23, 26 may be vertically asymmetrically formed. For example, lengths of the first resilient pieces 23 in the front-back direction may be shorter than those of the second resilient pieces 26 and the first and second resilient pieces 23, 26 can be arbitrarily formed according to a need.

(5) The first and second resilient pieces 23, 26 may be folded to extend forward from the rear end edge of the tubular portion 14.

LIST OF REFERENCE SIGNS

10: female terminal
11: male terminal

14: tubular portion
15: bottom wall
17: ceiling wall
23: first resilient piece
24 first base end portion
26: second resilient piece
27: second base end portion
28: second contact portion (contact portion)

The invention claimed is:

1. A female terminal, comprising:

a tubular portion having a front end and opposite first and second walls extending rearward from the front end, the tubular portion being configured to receive a male terminal inserted into the tubular portion from the front end;

a first base extending from the first wall of the tubular portion and being folded rearward to extend into the tubular portion from the front end of the tubular portion;

a plurality of first resilient pieces projecting inwardly of the tubular portion from an end of the first base in the tubular portion and being arranged side by side in a direction intersecting an inserting direction of the male terminal into the tubular portion so that the first resilient pieces are branched from the first base at a position within the tubular portion, each of the first resilient pieces having a first main body portion extending continuously from the end of the first base to a first free end of the respective first resilient piece, the first free end of each of the first resilient pieces being spaced from the first and second walls of the tubular portion, a first bend substantially adjacent the first free end of the respective first resilient piece so that the first free end extends toward the first wall, each of the first bends defining a first linear contact portion aligned in a direction intersecting the inserting direction of the male terminal;

a second base extending from the second wall of the tubular portion and being folded rearward to extend into the tubular portion from the front end of the tubular portion; and a plurality of second resilient pieces projecting inwardly of the tubular portion from an end of the second base in the tubular portion and being arranged side by side in the direction intersecting the inserting direction of the male terminal into the tubular portion, each of the second resilient pieces having a second main body portion extending continuously from the end of the second base to a second free end of the respective second resilient piece, the second free end of each of the second resilient pieces being spaced from the first and second walls of the tubular portion, a second bend substantially adjacent the second free end of the respective second resilient piece so that the second free end extends toward the second wall, each of the second bends defining a second linear contact portion aligned in the direction intersecting the inserting direction of the male terminal, wherein the second linear contact portion of each of the second resilient pieces respectively corresponding to the first linear contact portion of each of first resilient pieces, and the second resilient pieces and the first resilient pieces being configured to sandwich the male terminal therebetween with the male terminal being in contact with the first and second linear contact portions, and wherein the first and second resilient pieces twist independently of one another to maximize contact with the male terminal that is twisted during insertion.

2. The female terminal of claim 1, wherein two of the first resilient pieces extend from positions on the first base near opposite end parts of the first base in the direction intersecting the inserting direction, and wherein two of the second resilient pieces extend from positions on the second base near opposite end parts of the second base in the direction intersecting the inserting direction.

3. The female terminal of claim 1, wherein the tubular portion includes opposed third and fourth walls extending from opposite lateral sides of the first wall, the second wall extending from an end of the third wall remote from the first wall and projecting toward an end of the fourth wall remote from the first wall.

4. The female terminal of claim 1, wherein each of the first and second main body portions defines a flat plate shape.

5. The female terminal of claim 1, wherein the plurality of first resilient pieces includes three first resilient pieces and the plurality of second resilient pieces includes three second resilient pieces.

* * * * *